United States Patent [19]

Zimmerman

[11] 4,143,520

[45] Mar. 13, 1979

[54] CRYOGENIC REFRIGERATION SYSTEM

[75] Inventor: James E. Zimmerman, Boulder, Colo.

[73] Assignee: The United States of America as represented by the Secretary of the Navy, Washington, D.C.

[21] Appl. No.: 863,840

[22] Filed: Dec. 23, 1977

[51] Int. Cl.[2] ..... F25B 9/00
[52] U.S. Cl. ..... 62/6
[58] Field of Search ..... 62/6

[56] References Cited

U.S. PATENT DOCUMENTS

| | | | |
|---|---|---|---|
| 3,221,509 | 12/1965 | Garwin | 62/6 |
| 3,222,877 | 12/1965 | Brooks | 62/6 |
| 3,650,118 | 3/1972 | O'Neil | 62/6 |
| 3,877,239 | 4/1975 | Leo | 62/6 |
| 4,092,829 | 6/1978 | Durenec | 62/6 |

FOREIGN PATENT DOCUMENTS

| | | | |
|---|---|---|---|
| 1504138 | 10/1967 | France | 62/6 |

*Primary Examiner*—Lloyd L. King
*Attorney, Agent, or Firm*—R. S. Sciascia; L. I. Shrago; C. E. Vautrain, Jr.

[57] ABSTRACT

A simply constructed low input power cyclic cryogenic refrigerator suitable for cooling superconducting quantum interfering devices (SQUID) and similar instruments is provided. A Stirling machine having a multistage displacer and a piston as its only essential moving parts, with helium gas as the working fluid, achieves and maintains a temperature of substantially 8.5° K. The working cylinder and displacer are separated by a tube and are fitted together precisely at steady-state operation rather than at room temperature. The displacer preferably is made of nylon and its cylinder of an epoxy-glass composite to provide the nearly optimum clearance required to maintain the 8.5° K. temperature for continuous periods on the order of several weeks.

12 Claims, 4 Drawing Figures

CRYOGENIC REFRIGERATION SYSTEM

The present invention concerns cryogenic cooling of small superconducting devices and, more particularly, prolonged cooling of these and similar instruments by a simplified low-power closed-cycle cryogenic refrigerator.

With the advent of the Josephson effect and other recent developments such as a superconducting bolometer, a super-Schottky diode, and certain computer elements, a number of practical electronic instruments have been developed which are vastly superior in terms of sensitivity, operating speed, portability, etc. to their conventional room-temperature components. These instruments presumably would universally replace their counterparts were it not for the expense and inconvenience required to maintain a low-temperature environment for the foregoing devices. Although superconductivity has been demonstrated up to about 23° K., most of the present devices work best at temperatures below about 9° or 10° K. It is almost universal practice to maintain this low-temperature environment by means of a liquid-helium cryostat, but the expense, inconvenience and considerable technical expertise required to maintain and operate such cryostats puts superconducting instruments at a severe disadvantage. Thus, in spite of their inherent great superiority over similar room-temperature instruments, they are presently used only by a relatively small number of cryogenic specialists and a few nonspecialists. Since there is little prospect of developing room-temperature superconductors, it is desirable and necessary to improve the methods and means of maintaining low temperatures so as to provide inexpensive, simple and efficient mechanisms and processes for maintaining superconducting or other devices at appropriate operating temperatures. The present invention meets this requirement.

Accordingly, it is an object of the present invention to provide a cryocooler that uses on the order of 10 to 100 times lower input power than existing experimental or commercial units.

Another object of this invention is to provide a low input power cryocooler having a low operating speed that produces several orders of magnitude lower magnetic interference and mechanical noise than existing cryocoolers.

A further object of this invention is to provide a low input power cryocooler that uses materials not previously considered for the moving and stationary parts of a reciprocating refrigerator to achieve the very low tolerances required to operate at low input powers on the order of 10 watts.

Other objects, advantages and novel features of the invention will become apparent from the following detailed description thereof when considered in conjunction with the accompanying drawings in which like numerals represent like parts throughout and wherein.

The invention, in general, uses the principle of the Stirling machine to provide a working atmosphere for cooling superconducting quantum interfering devices (SQUID) or other similar instruments. Of the two essential moving parts of the Stirling machine, the piston and the displacer, the displacer is the more critical for achieving very low temperatures. According to the invention, the displacer and its cylinder are of such materials that extremely small clearances constructed between them may be formed simply and accurately by using nylon for the displacer and a glass-reinforced epoxy for the displacer cylinder. The nylon displacer is forced into the epoxy-glass cylinder at room temperature and no clearance, and thereafter the assembly is heated to 80° to 90° C. for a few minutes. This procedure anneals and relaxes the nylon into precise conformation with the cylinder so that when they are cooled to room temperature both members have precisely the same shape and, since nylon shrinks slightly more than the epoxy-glass composite, a nearly optimum clearance is established upon cooling by the inherent properties of the materials. This method of forming the displacer and its cylinder enables a temperature of on the order of 8.5° to 13° K. to be achieved in a durable, very inexpensively made cryocooler.

Figure 1:
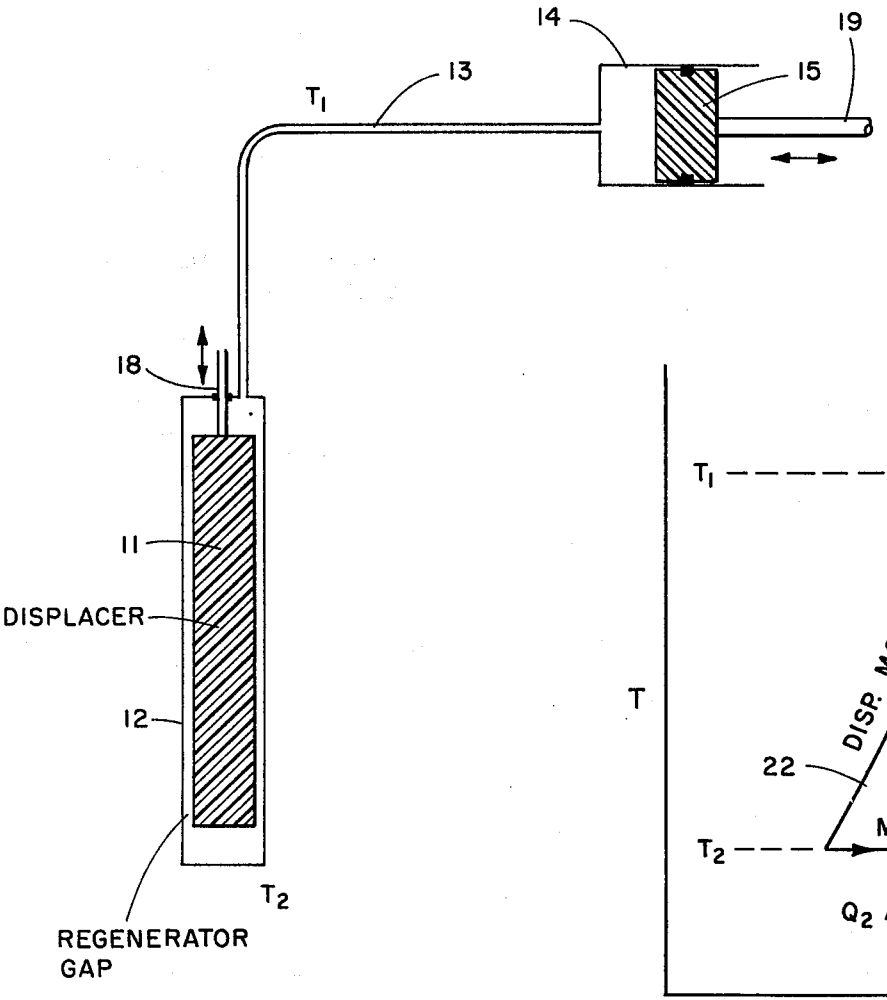
FIG. 1 is a schematic representation of the operation of a split Stirling machine.

Referring to the drawings, FIG. 1 shows a split Stirling machine in simple form which includes a displacer 11 which fits loosely in a cylinder 12, with cylinder 12 connected by a line 13 to a piston chamber 14 in which a piston 15 is positioned. Displacer 11 fits loosely in cylinder 12 so that the gas contained in the system can move freely past it, resulting in nearly the same pressure throughout the total volume of the system. Work may be done on the system as the piston moves back and forth, but no work is done by or on the displacer since displacer motion, in response to a displacer rod 18 coupled to a piston rod 19, does not change the volume of the system.

Figure 2:
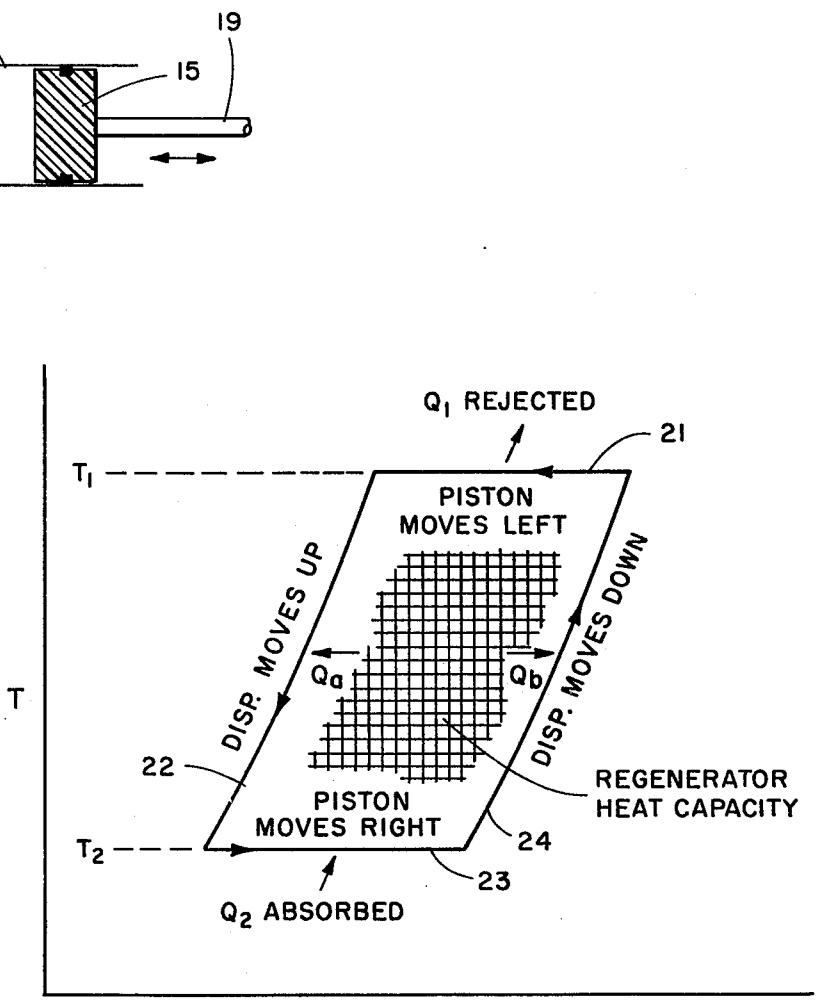
FIG. 2 is a graphical presentation of an idealized thermodynamic cycle of the machine of FIG. 1 on a temperature-entropy diagram.

The idealized thermodynamic cycle of the operation of the split Stirling machine on a temperature-entropy diagram is shown in FIG. 2. When displacer 11 is in its lowest position, piston 15 is moved to the left thereby compressing the working fluid, which may be helium gas, and producing a heat of compression $Q_1$ which is rejected at ambient pressure $T_1$, typically 300° K., as indicated at 21. Next, the displacer is moved to the top of its cylinder, displacing the working fluid from the top to the bottom of the cylinder. Assuming that the machine is already in steady-state operation, with the bottom end at a low temperature $T_2$, and a stable temperature gradient along the displacer, then the fluid being displaced in cylinder 12 gives up heat $Q_a$ to the displacer and its cylinder walls along the annular gap as indicated at 22, and arrives at the bottom end at temperature $T_2$. Then the piston is moved to the right, expanding the fluid and producing a flow of heat $Q_2$ into the fluid at temperature $T_2$ at the bottom of the cylinder as indicated at 23. Finally, the displacer is moved to its lowest position, displacing the remainder of the fluid back to the top of the cylinder and completing the cycle. The fluid picks up heat $Q_b$ from the walls of the annular gap as it travels from $T_2$ to $T_1$ as indicated at 24. In steady-state operation it is required that $Q_a = Q_b$, otherwise the temperature gradient along the displacer and the cylinder wall will change with time. With real gases, such as helium at 20° K. and below, the requirement $Q_a = Q_b$ is incompatible with the assumption of isothermal heat exchange $Q_1$ and $Q_2$ at $T_1$ and $T_2$. That is, the enthalpy change $Q_a$ or $Q_b$ between two given temperatures $T_1$ and $T_2$ depends on pressure so the requirement $Q_a = Q_b$ means that the expansion cannot be strictly isothermal. This is a limitation, or at least an analytical complication, in the operation of the Stirling cycle. A more serious limitation, which the present invention is concerned with, is that the heat capacity of the walls at the cold end becomes insufficient, relative to that of the fluid, to efficiently provide the necessary heat exchange $Q_a$ and $Q_b$.

Figure 3:
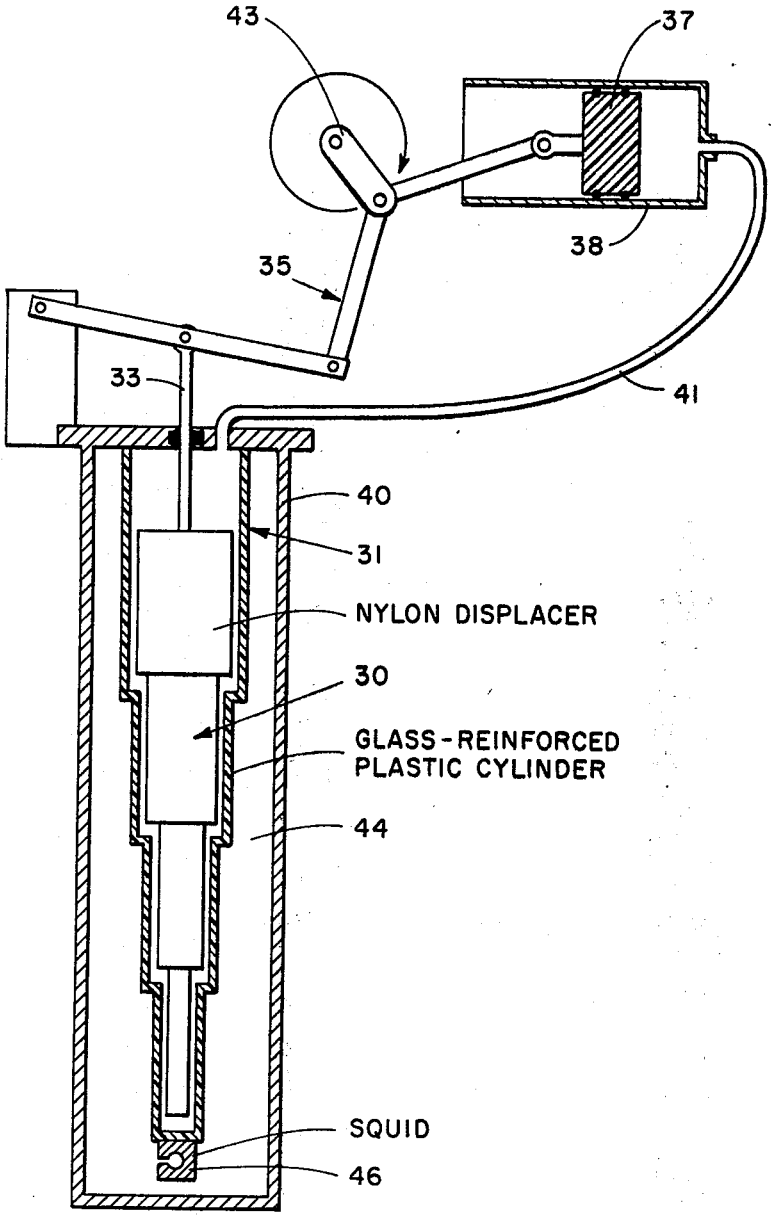
FIG. 3 is a schematic representation of a multistage cryocooler constructed in accordance with the present invention.

Materials having the favorable properties of large heat capacity and thermal conductivity are required for use in regenerative heat exchangers at low temperatures. For use with SQUID magnetometers, the materials must also have favorable properties relative to generation of electromagnetic interference and noise in the SQUID. FIG. 3 is a schematic diagram of a multistage Stirling machine adapted specifically for cooling a SQUID. A cascaded displacer 30 is made of nylon and its enclosing cylinder 31 is made of an epoxy-glass composite, with a very small clearance, which is exaggerated in the figure, allowed between the displacer and the cylinder. Displacer 30 preferably is machined for a tight fit, i.e. no clearance at room temperature, in cylinder 31. Since nylon shrinks slightly more than the epoxy-glass composite, a nearly optimum clearance is established by this inherent property of the materials as the machine cools down to the operating temperature. To assure a conformity between the displacer and the cylinder, the displacer is forced into the cylinder at room temperature and the assembly is heated to from 80° to 90° C. for a few minutes. This procedure anneals and relaxes the nylon displacer into precise conformation with the cylinder so that when cooled to room temperature both members have precisely the same slight bends, if any, in the same direction. The properties of the materials are thus used again to solve what direction otherwise be exacting and expensive shaping of the displacer to the cylinder. Displacer 30 is mounted on a rod 33 which is connected by a linkage of connecting rods generally indicated at 35 to a piston 37 which is positioned in a cylinder 38. Displacer 30 and cylinder 31 are mounted in a housing 40 which is connected by a line 41 to piston cylinder 38, and a fluid such as helium gas is admitted into the system so as to completely fill the volume contained by the piston and displacer cylinder 31. A crankshaft 43 is connected to rotary power means, not shown, to produce the desired alternate compression and expansion of the gas in the system by reciprocal operation of piston 37 and displacer 30. A vacuum is produced within a chamber 44 in housing 40 and a SQUID 45 mounted at the narrow bottom end of cylinder 31 is exposed to low temperatures on the order of from 13° to 8.5° K. which can be achieved by operation of the system.

Figure 4:
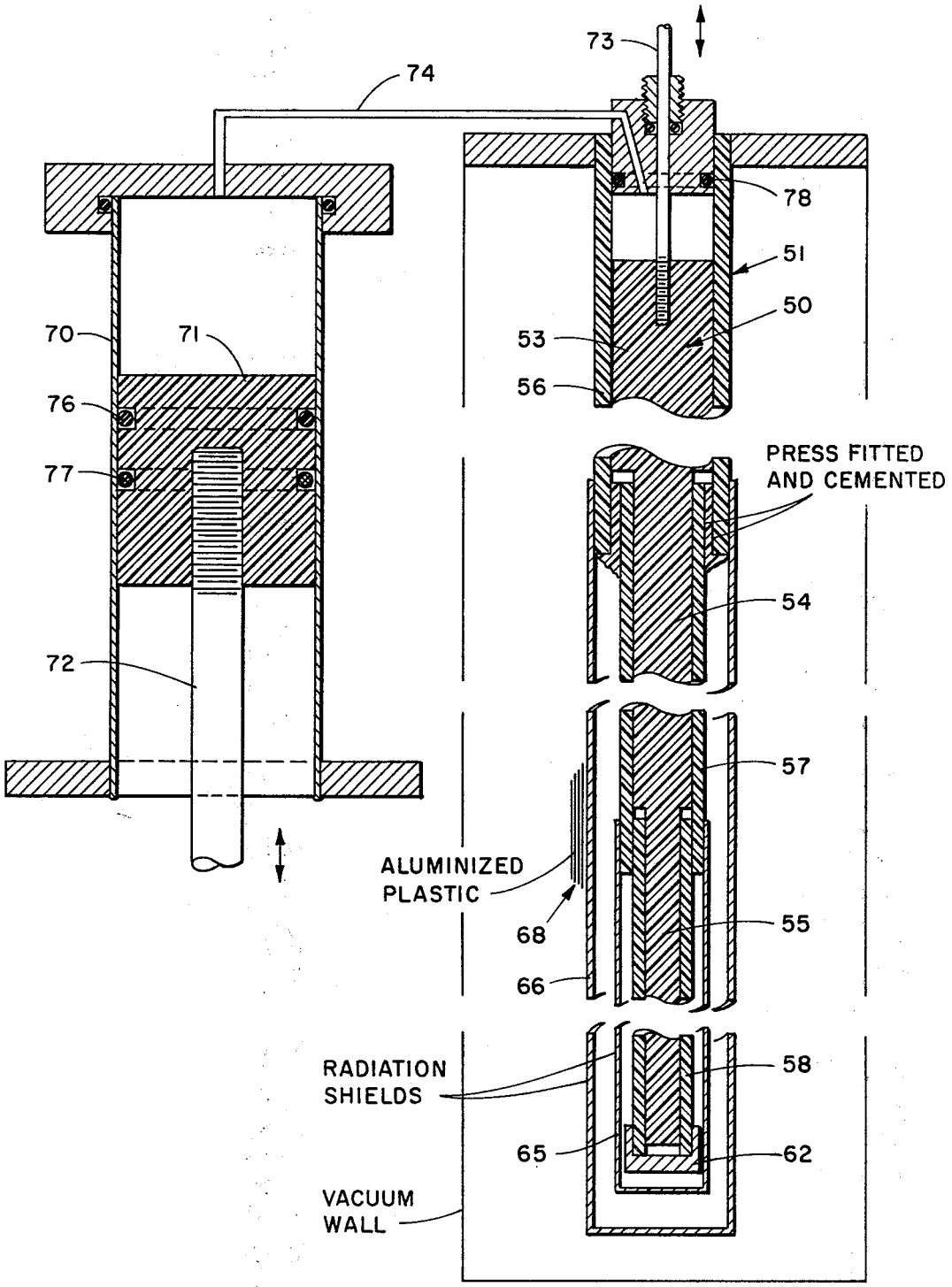
FIG. 4 is a schematic drawing of a preferred embodiment of the Stirling cryocooler of the present invention.

FIG. 4 illustrates a preferred embodiment of the invention wherein a nylon displacer-regenerator 50 made of three solid nylon rods is positioned in a cylinder 51 preferably assembled in three sections from glass-reinforced epoxy tubing. The preliminary dimensions of the nylon rod stages are 245 mm in length for a first stage 53 of the displacer-regenerator 50 with a 19 mm diameter and an 0.05 mm radial clearance inside the cylinder. The second stage rod 54 preliminary dimensions are a length of 143 mm with a 9.45 mm diameter and an 0.07 mm radial clearance. The third stage 55 dimensions are a length of 144 mm with a 4.7 mm diameter and an 0.04 mm radial clearance. These dimensions have been found to produce a machine capable of cooling to temperatures on the order of 13° to 8.5° K. but are representative only of other typical dimensions. It will be appreciated that the radial clearances are too narrow to be shown in the drawings. The cylinder sections 56–58 surrounding each of the displacer stages all have a typical substantially 2.4 mm wall thickness and are epoxied together using a commonly available epoxy glue. A brass cap 62 is epoxied on the bottom or cold end of displacer 50, and cylindrical aluminum radiation shields indicated at 65 and 66 are fitted over lower end sections 54 and 55. A plurality of layers of aluminized plastic sheets which are indicated at 68 are wrapped within the shields and around the outside of the assembly for additional radiation shielding. A polished stainless steel cylinder 70 containing a typical 35.6 mm diameter plastic piston 71 form of compressor is coupled to the chamber housing the displacer by a 1 m long connecting line 74 preferably having a 2 mm inside diameter.

The foregoing dimensions, as noted supra, are variable within the concept of the invention. Piston 71 is attached to a piston rod 72 and driven through a 38 mm stroke by a crankshaft and crosshead mechanism, not shown, which is connected to displacer 50 by a push rod 73. A suitable crosshead mechanism may be one adapted from a small commercial freon compressor which operates at 1 Hz with a displacer stroke of 12.7 mm and a pressure excursion of about 3 to 13 Pa. The piston is sealed in its cylinder preferably by a rubber piston ring 76 and a felt grease ring 77 while the displacer is sealed in its cylinder by a preferably rubber O-ring 78.

The performance achieved is attributed in part to the differential contraction of the displacer. After initial cool-down, the dead space is eliminated by readjusting the length of displacer push rod 73. When this is done, the phase angle between the piston and the displacer is empirically optimized. Efficient operation of the machine at these low temperatures requires that the clearance between the displacer and the displacer cylinder be very small, i.e. substantially 0.002 to 0.005 cm over the entire length. With the present displacer carefully machined to fit the cylinder with less than an 0.1 mm radial gap on all three sections, this requirement is realized and essential regenerative heat exchange can take place between the working fluid, such as helium gas, and the solid surface along the radial gaps.

During the expansion stroke of the piston, refrigeration is produced at the two larger steps of the displacer as well as at the small end, the expansion volumes being substantially 2.7 $cm^3$, 0.68 $cm^3$ and 0.23 $cm^3$, respectively, totaling 3.6 $cm^3$. Under these conditions, the invention has been operated a total of substantially 5000 hours at one stroke per second, with the helium pressure oscillating between 3 and $12 \times 10^5$ $N/m^2$. The machine required 50 W input to an electric drive motor whose measured efficiency was less than 25%. Thus, the actual mechanical power input was approximately 10 W which agrees generally with the power calculated from the piston displacement and the pressure excursion. A temperature at the small end of the displacer of 13° K. has been maintained under the foregoing conditions, and of 8.5° K. for one month after minor refinements were made.

A pure niobium SQUID has been routinely operated in the machine for a period of over one month. It is noted that the superconducting transition temperature of niobium is about 9° K. This operation demonstrated that the interference at the SQUID generated by the machine is very much smaller than that for any commercially available machine. The interference level achieved is on the order of $10^{-10}$ tesla.

There is thus provided an inexpensive and efficient cryocooler that is made of non-magnetic insulating materials such as nylon and glass-reinforced epoxy. The invention shows that these materials may be used in reciprocating machines and, in the cryogenic art, have a substantial lifetime while producing and maintaining extremely low temperatures with very low input power. Because of these materials, a simplified construction, low operating speed and power, and several orders of magnitude lower magnetic and mechanical noise or interference in superconducting devices are realized. These outstanding results are achieved partially through the unique manner in which the very close tolerances required in a machine operating on such low input power are obtained.

Obviously, many modifications and variations of the invention are possible in the light of the foregoing teachings.

What is claimed is:

1. A system for obtaining and maintaining low cryogenic temperatures in a low input power cyclic cryogenic refrigerator using the principle of the Stirling refrigeration cycle comprising:

a piston cylinder and a plastic piston mounted therein for prolonged reciprocating motion at low cryogenic temperatures;

a cascaded multistage displacer cylinder and a cascaded multistage displacer mounted therein in side wall tolerance therewith of substantially 0.005 to 0.002 cm;

a vacuum vessel containing said displacer cylinder and a vacuum in said vessel;

a conduit communicating between said piston cylinder and said displacer cylinder so as to provide a closed volume and a cryogenic fluid filling said volume;

means coupled to said piston and said displacer for providing cyclic operations thereof, said tolerance and said displacer and displacer cylinder cooperating to provide substantially frictionless reciprocating motion of the displacer in the displacer cylinder and the necessary heat exchange therebetween to reduce the temperature at the remote end of said displacer of least diameter to values on the order of 8.5° K. to 13° K., said tolerance achieved by shaping said displacer to substantially conform to said displacer cylinder at room temperature, said displacer annealed by heating said displacer in said displacer cylinder and relaxed by subsequent cooling so that precise conformation between contacting surfaces thereof is obtained.

2. The system of claim 1 wherein said displacer and said displacer cylinder are made substantially of different synthetic materials to produce said tolerance on cooling.

3. The system of claim 2 wherein said displacer is made of nylon and said displacer cylinder is made of epoxy reinforced by glass.

4. The system of claim 3 wherein said displacer and displacer cylinder formed in three sections having length-to-diameter ratios of substantially 12 to 1, 15 to 1 and 30 to 1 successively from the largest diameter section to produce essential refrigeration at each section.

5. The system of claim 4 wherein the expansion volumes at said successive sections are substantially 2.7 $cm^3$, 0.68 $cm^3$ and 0.23 $cm^3$, said piston having substantially a 35.6 mm diameter and 38 mm stroke to produce said cooling in cooperation with said displacer.

6. A low input cryocooler operating on the Stirling refrigeration cycle comprising:

a three-stage cylindrical displacer-regenerator and a displacer cylinder receiving said displacer-regenerator in close fitting relationship along the side walls thereof, said relationship on the order of substantially 0.002 to 0.005 cm over the full length of the opposed cylindrical surfaces of said displacer cylinder and displacer-regenerator to provide the essential regenerative heat exchange to reduce the temperature at the remote end of the stage of smallest diameter to values on the order of 8.5° K. to 13° K., said relationship achieved by forming said displacer-regenerator and displacer cylinder substantially of different synthetic materials having differing ratios of contraction on cooling said precisely conforming said above members by heating and subsequent cooling;

a piston cylinder and a plastic mounted therein for prolonged reciprocating motion at low cryogenic temperatures;

means coupled to said piston and said displacer-regenerator for providing cyclic operation thereof;

a vacuum vessel containing said displacer cylinder and a vacuum in said vessel; and a conduit communicating between said piston cylinder and said displacer cylinder so as to provide a closed volume and a cryogenic fluid filling said volume.

7. The cryocooler of claim 6 wherein said piston and said displacer-regenerator are made of nylon and said displacer cylinder is made of epoxy reinforced by glass to reduce magnetic interference and mechanical noise.

8. The cryocooler of claim 7 wherein said displacer-regenerator and displacer cylinder are formed in stages having length-to-diameter ratios of substantially 12 to 1, 15 to 1 and 30 to 1 successively from the largest diameter stage to produce essential refrigeration at each stage.

9. The cryocooler of claim 8 wherein the expansion volumes at said successive stages are substantially 2.7 $cm^3$, 0.68 $cm^3$ and 0.23 $cm^3$, said piston having substantially a 35.6 mm diameter and a 38 mm stroke to produce said cooling in cooperation with said displacer.

10. A method of obtaining and maintaining temperatures on the order of 13° K. to 8.5° K. at low levels of magnetic interference and mechanical noise and low power input in a split Stirling machine having a multistepped gap regenerator comprising:

forming the multistepped displacer-regenerator in very close fit in the multistepped displacer cylinder by differential contraction of the displacer-regenerator in the displacer cylinder;

forming a compressor piston of plastic for very close fit in its cylinder;

coupling the displacer-regenerator to the piston and connecting the piston cylinder to the displacer cylinder to form a closed volume; and enclosing in a vacuum and shielding from radiation the displacer cylinder, said very close fit of the displacer-regenerator in the displacer cylinder achieved by using a plastic material to form the displacer-regenerator and an epoxy reinforced by glass to form the displacer cylinder.

11. The method of claim 10 wherein the displacer-regenerator is first machined to fit tightly within the displacer cylinder at room temperature and then these components are heated sufficiently in the assembled condition to anneal and relax the displacer-regenerator into precise conformation with the displacer cylinder so that when cooled to room temperature both components have precisely fitted surfaces, said differential contraction of the displacer-regenerator at low temperatures providing the very close clearance between displacer and cylinder steps over the total lengths thereof for operation at low speed and low input power.

12. The method of claim 11 wherein the displacer-regenerator and compressor piston are made of nylon and said assembly of components is heated to substantially 80° to 90° C. for a few minutes, the steps of said displacer-generator provide successive expansion volumes of substantially 2.7 $cm^3$, 0.68 $cm^3$ and 0.23 $cm^3$, the piston has a substantially 35.6 mm diameter and 38 mm stroke, and interference levels on the order of $10^{-10}$ tesla are available at the remote end of the smallest diameter stage for cooling small superconducting devices and similar instruments.

* * * * *